US006224036B1

(12) United States Patent
Prince et al.

(10) Patent No.: US 6,224,036 B1
(45) Date of Patent: May 1, 2001

(54) CONCRETE REINFORCEMENT CABLE TENSIONER

(75) Inventors: George T. Prince, Sussex; William J. Gordon, Franklin, both of WI (US)

(73) Assignee: Applied Power Inc., Milwaukee, WI (US)

( * ) Notice: Subject to any disclaimer, the term of this patent is extended or adjusted under 35 U.S.C. 154(b) by 0 days.

(21) Appl. No.: 09/341,585

(22) PCT Filed: Jan. 16, 1998

(86) PCT No.: PCT/US98/00950

§ 371 Date: Jul. 14, 1999

§ 102(e) Date: Jul. 14, 1999

(87) PCT Pub. No.: WO98/31897

PCT Pub. Date: Jul. 23, 1998

Related U.S. Application Data

(60) Provisional application No. 60/037,635, filed on Jan. 17, 1997.

(51) Int. Cl.[7] ..... E21B 19/00

(52) U.S. Cl. ..... 254/29 A; 29/452

(58) Field of Search ..... 254/29 A, 29 R, 254/51, 93 H, 93 R; 29/452; 52/223 R, 223 L, 225, 230

(56) References Cited

U.S. PATENT DOCUMENTS

| | | | | |
|---|---|---|---|---|
| B 591,615 | | 3/1976 | Wyder . | |
| 1,745,067 | * | 1/1930 | Torrance | 254/93 H |
| 1,902,827 | * | 3/1933 | Bolens | 254/93 H |
| 3,701,509 | | 10/1972 | Stinton . | |
| 3,703,030 | | 11/1972 | Simms . | |
| 4,598,897 | * | 7/1986 | Aikioniemi | 254/29 A |
| 4,746,096 | * | 5/1988 | Donnell et al. | 254/29 R |
| 4,805,877 | * | 2/1989 | Hoekstra | 254/29 A |

FOREIGN PATENT DOCUMENTS

| | | | | |
|---|---|---|---|---|
| 716195 | | 12/1968 | (BE) . | |
| 961759 | | 3/1957 | (DE) . | |
| 2236075 | * | 9/1971 | (DE) | 254/29 R |
| 2091230 | | 1/1972 | (FR) . | |

* cited by examiner

*Primary Examiner*—David A. Scherbel
*Assistant Examiner*—Daniel Shanley
(74) *Attorney, Agent, or Firm*—Quarles & Brady LLP

(57) ABSTRACT

A concrete reinforcement cable tensioner (10) has a cable gripper (60) with its base end (87) mounted to a flange (18) which is secured to the tensioning cylinders (12, 14) by abutting a shoulder on the outside of the cylinders (12, 14). An auxiliary retraction spring (94) is contained in a tubular handle (86) which is fixed to the flange (18) and the spring (94) acts on a rod (92) which extends beyond the handle (86) and has its distal end fixed to a yoke (104) which connects the piston rods (30) of the cylinders (12, 14) and on which a seat (108) for bearing against the concrete slab is mounted. The base ends (24) of the tensioning cylinders (12, 14) are hydraulically connected by a manifold (16) which is common to the cylinders (12, 14) and binds the base ends (24) of the cylinders (12, 14) together.

9 Claims, 4 Drawing Sheets

CONCRETE REINFORCEMENT CABLE TENSIONER

This claims the benefit of U.S. Provisional Patent Application No. 60/037,635 filed Jan. 17, 1997.

FIELD OF THE INVENTION

This invention relates to a hydraulic cylinder operated device for tensioning reinforcement cables in green concrete.

DISCUSSION OF THE PRIOR ART

Concrete is sometimes reinforced with braided wire cables, sometimes referred to as wire rope. For example, a grid of such cables may be placed in a concrete form, the concrete poured and allowed to set into a semi-cured state, referred to as green concrete, and while green the cables, which extend beyond the concrete slab, are tensioned so that they are under a tensile stress, thereby exerting a compressive load on the slab. The cables extend all the way through the slab and beyond the side edges of it, so that they may be grasped by the tensioning mechanism. Typically, one end of each cable is anchored to the slab at one side edge and the other end is grasped by the hydraulic tensioning device.

Such tensioning devices typically have two hydraulic cylinders with a gripping mechanism fixed to the cylinders for grasping the cable and a seat secured to the piston rods of the cylinders for bearing (directly or indirectly) against the side edge of the concrete slab so that a tension of a high magnitude can be exerted on the cable. A seat which mates with the tensioning tool is typically cast into the side edge of the concrete where the cable comes out and the cable extends through the seat and through a grommet in the seat which only permits one way movement of the cable through the grommet. In other words, when the cable is being tensioned the cable can move through the grommet, but when the cable attempts to move backwardly through the grommet back into the slab, the grommet engages the cable and tightens around it to prevent such reverse movement and consequent reduction in the tensile force on the cable. Tensioning devices for performing this operation, seats and grommets are all well known.

In the currently existing tensioning devices, a significant length of cable must be extended past the side edge of the slab where the tensioning device is operated to be grasped by the device. If the cable length extending beyond the side edge of the slab is less than that required by the tensioning device to grip the cable, for example if the cable is cut too short, or if when pouring the concrete a worker steps on the cable, thereby pulling it back through the seat which is cast into the slab, an extension cable may need to be assembled to the end of the cable so that it can be grasped by the tensioner. This can be a very tedious and time consuming process, involving several hours of additional labor.

In addition, speed is of the utmost importance in tensioning cables. Typically, a tensioner operator may do nothing but tension cables. The operator may be paid per pull, i.e. per cable tensioned, so the operator wants to tension each cable as quickly as possible. For long cables, the tensioning device may stroke several times for each cable. Thus, the speed of operation of the tensioning device is important.

The extension speed of the tensioner is determined by the flowrate of hydraulic fluid to the tensioner, which is to a certain extent at least under the control of the operator. However, for single acting cylinders the retraction speed of the tensioner is determined by the cylinders and particularly by the springs inside the cylinders which act to return them. In addition, since a tensioner of this type is constantly being handled by the operator, it is important that the tensioner be easy to use, handle, move and supply hydraulic fluid to. Since these tensioners are also used on construction sites, they must also be rugged.

SUMMARY OF THE INVENTION

The invention provides a concrete reinforcement cable tensioner which addresses the above described needs. Thus, as in prior art concrete reinforcement cable tensioners, a tensioner of the invention has one or more hydraulic cylinders, a cable gripper mounted to the cylinders for gripping a cable and a seat for bearing directly or indirectly against the concrete, so that the gripper and the seat can be separated under a hydraulically generated force to apply tension to the reinforcement cable. However, a tensioner of the invention is improved, in one aspect, in that the gripper is mounted to each of the cylinders by a flange which engages a shoulder of each of the cylinders. Thus, the gripper can be mounted in such a manner so that the length of cable required to protrude from the green concrete slab is reduced, i.e., a shorter grip length is required, which can obviate the time consuming process of having to extend a cable which does not extend beyond the slab far enough for the prior art tensioners to grip it. In this aspect, the gripper is mounted to the flange at a base end of the gripper, i.e., the end of the gripper which is closest to the base ends of the cylinders, which reduces the grip length by at least the thickness of the flange.

In another aspect, a tensioner of the invention is further provided with a spring external to cylinders for biasing the device to a retracted position. Such a spring is in addition to the usual retraction springs inside the cylinders, and therefore helps speed up retraction of the device, which reduces the time needed for each cable pull.

In another aspect, the spring is contained in a handle of the tensioner. The handle is preferably a tube, in which the spring is contained, and the spring is a compression spring which acts between a flange of an auxiliary spring rod and a cap of the tube. The rod extends through a hole in a cap of the tubular handle and is fixed at its distal end to the piston rods of the cylinders, for example, through a yoke which connects the piston rods and to which is mounted the seat.

In another aspect, the device has multiple cylinders and the base ends of the cylinders are hydraulically connected by a manifold which is common to the cylinders. Multiple ports at various locations can be provided in the manifold to permit a choice of places in which to establish a hydraulic connection with the manifold to connect a pump with the device. Those ports of the manifold which are not used to connect a pump to the cylinders are plugged.

These and other objects and advantages of the invention will be apparent from the detailed description and from the drawings.

DETAILED DESCRIPTION OF THE PREFERRED EMBODIMENT

Figure 1:
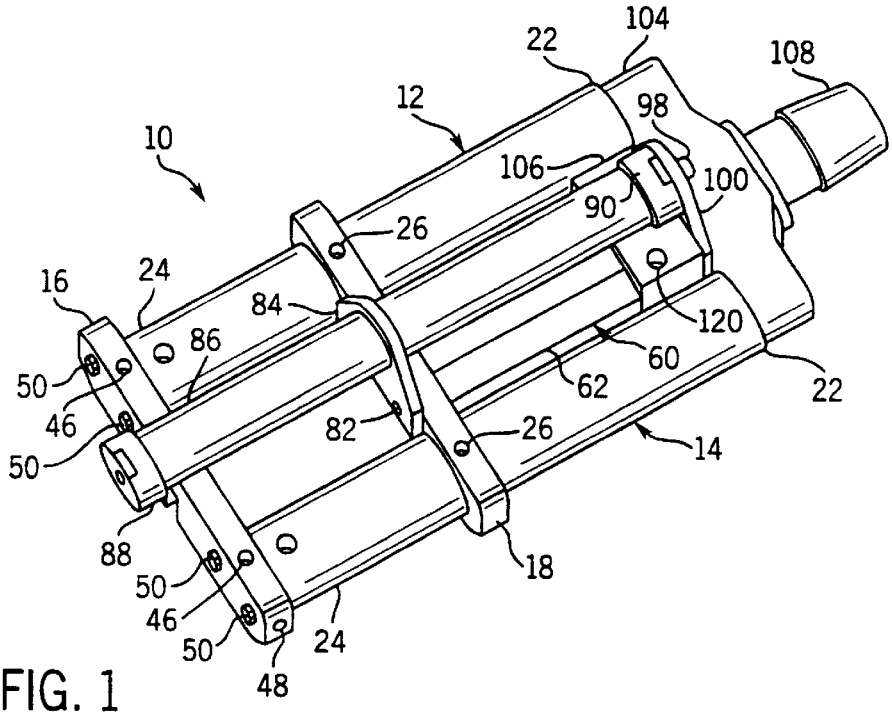
FIG. 1 is a perspective view of a cable tensioner of the invention shown in a retracted position.

A concrete reinforcement cable tensioner 10 of the invention includes a pair of single acting cylinders 12 and 14 which are bound together at their base ends 24 by a manifold 16 and are bound together at a point between their base ends 24 and rod ends 22 by a gripper mounting flange 18. Each cylinder 12 and 14 is shouldered at the position where the flange 18 resides, indicated at 20, so that the outer diameter of each cylinder 12 and 14 is greater between shoulder 20 and rod end 22 than it is between shoulder 20 and base end 24. The flange 18 has holes 19 in it sized to slide over the smaller diameter portions of the cylinders 12 and 14 but not over the larger diameter portions, so that flange 18 abuts shoulders 20 and is prevented thereby from moving any closer to the rod ends 22. Set screws 26 in the flange 18 secure the flange 18 against the shoulder 20.

The cylinders 12 and 14 are conventional (except for being stepped in outside diameter as described above) single acting cylinders. The rod 30 of each cylinder 12 and 14 is hollow (i.e. tubular) and an extension spring 32 having one end fixed to the closed end 34 of the rod 30 and the other end fixed to the base end 24 of the housing 36 of each cylinder 12 and 14. The connections between the extension spring and the respective rod 30 and housing 36 are conventional, not shown in detail, and could be provided by any suitable means. For example, in one type of connection a connector is screwed into each end of the extension spring, and each connector is pinned to the respective rod 30 or housing 36.

The base ends 24 of the cylinders 12 and 14 are in hydraulic fluid communication with one another via manifold 16. Each cylinder 12 and 14 has a single base end port 40 which is in fluid communication through an O-ring 42 with a port 44 formed in the manifold 16. The ports 44 are in fluid communication with one another by passageways formed within the manifold 16 including a pair of transverse passages 46 (FIG. 5), one for each port 44, and a lateral passageway 48 which extends lengthwise all the way through the manifold 16 and connects the passages 46.

The ends of the passageways 46 and 48 are tapped and are either plugged with a threaded plug or receive a threaded hydraulic connector, to provide a total of four possible positions in which to supply hydraulic fluid to the device 10, two of which are at the ends of passageway 48 and the other two of which are at the ends of the two passageways 46.

Figure 5:
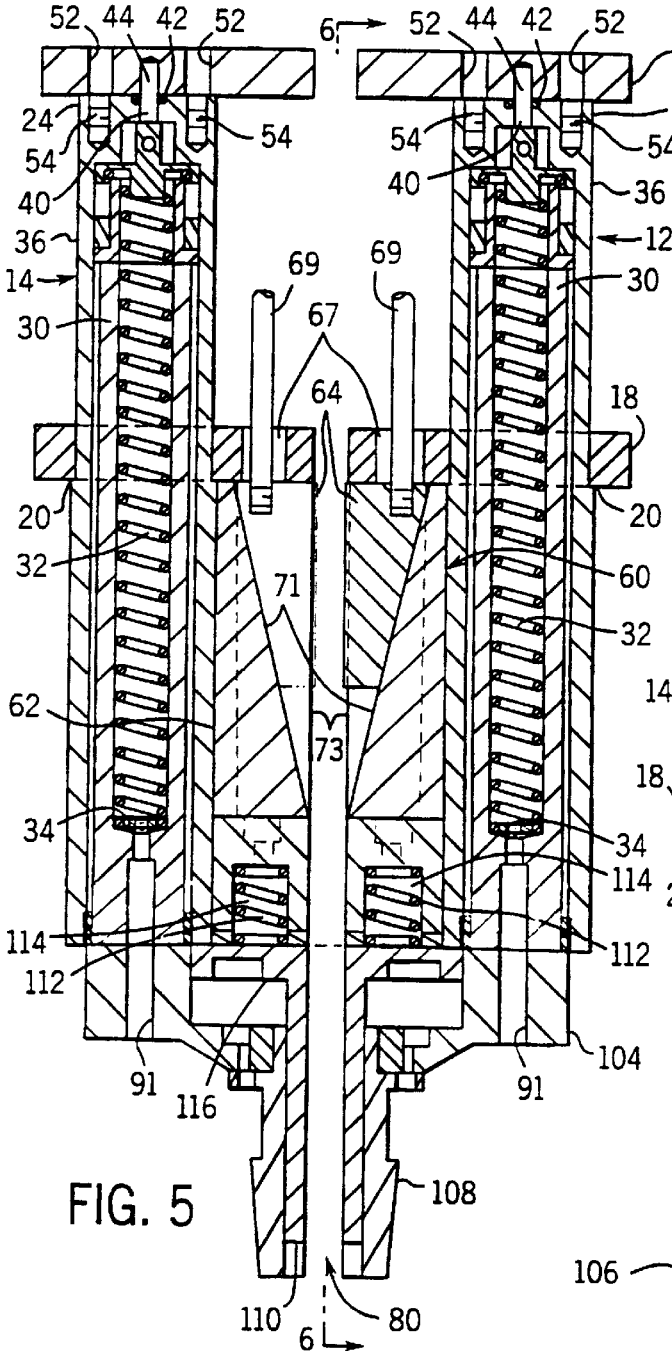
FIG. 5 is a sectional view from the plane of the line 5—5 of FIG. 6.
Figure 7:
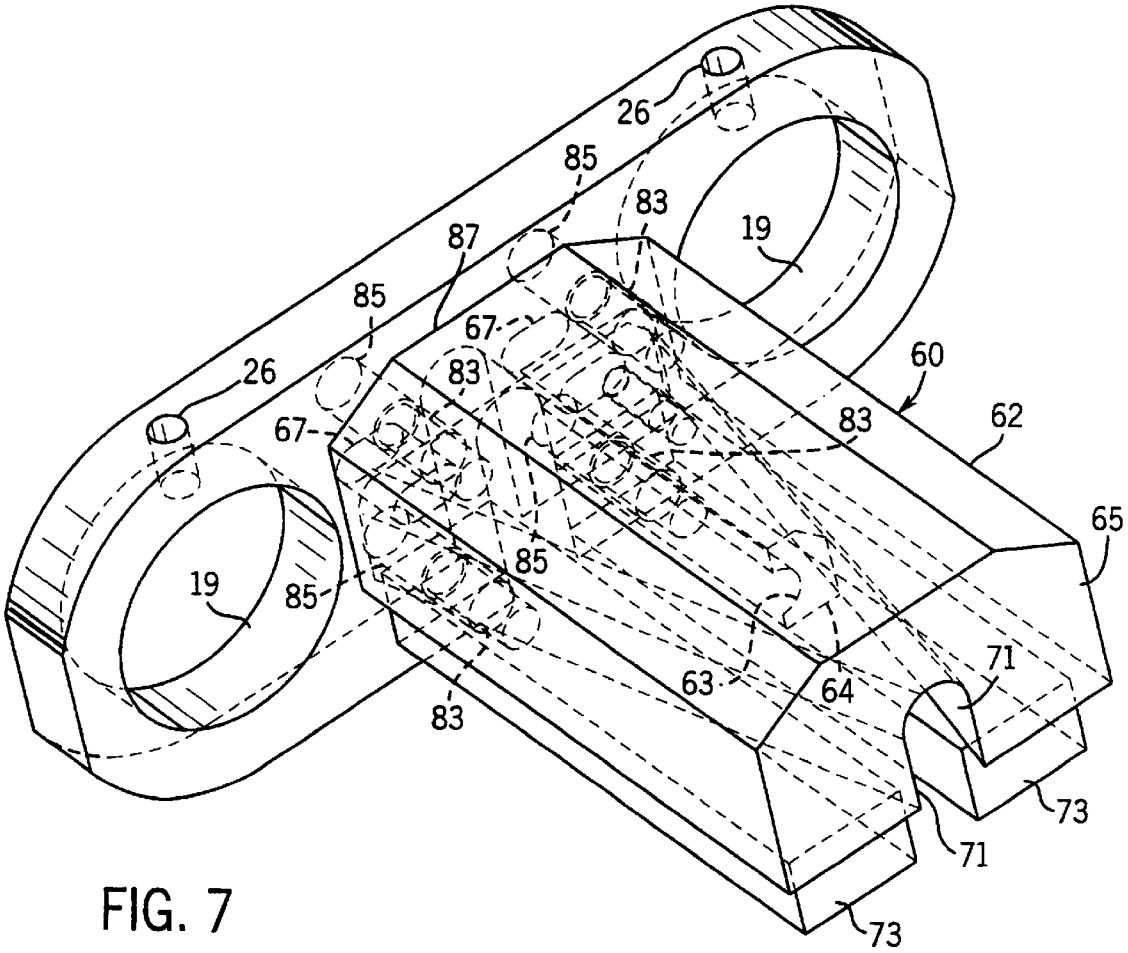
FIG. 7 is a front top perspective view of an assembly of a cable gripper and mounting flange of the tensioner of FIGS. 1–6.

The manifold 16 is bolted to the base ends 24 of the cylinders 12 and 14 by bolts 50 which extend through holes 52 in the manifold 16 that are threaded into holes 54 in the base ends 24. A gripper 60 of generally conventional design (except for the end at which it is anchored to the cylinders 12 and 14) includes a gripper housing 62 of the general shape shown in FIG. 7 and wedge shaped gripper jaws 64 which slide on angled surfaces within the gripper housing 62. Only the jaw 64 on the right side of the gripper housing 62 is illustrated in full lines in FIG. 5 and only the right jaw 64 is illustrated in FIG. 7 for purposes of illustration. The jaw 64 on the left side in FIG. 5 is shown in phantom, it being understood that in operation both the left and right jaws would be provided. Plates 73 are welded or otherwise affixed on the bottom side of housing 62 to help support the jaws 64 inside the housing 62.

The inside surfaces of the jaws 64 are serrated so as to grip a cable, as is well known. The serrated jaws 64 grip the cable and the tension generated in the cable when the device 10 is extended tends to move the jaws 64 toward the end 65 (hereafter referred to as the rod end) of the housing 62 which is closest to the rod ends 22 of the cylinders 12 and 14, which because of the wedge shape and angled surfaces 71 inside the housing 62 increases the strength of the grip exerted on the cable by the jaws 64.

Figure 4:
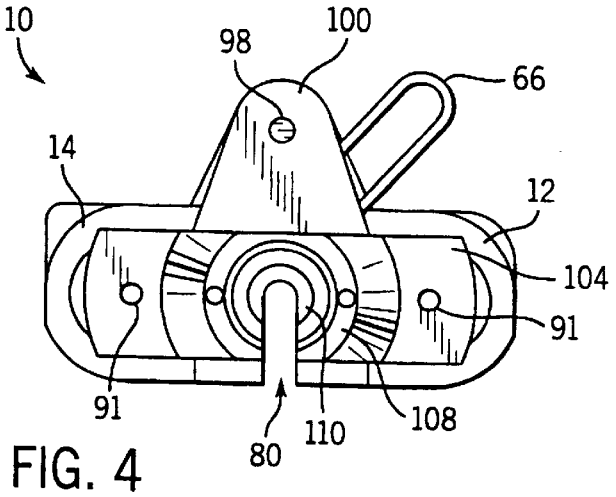
FIG. 4 is a front plan view of the tensioner of FIG. 1 and also illustrating a jaw retaining spring (the jaw retaining spring is also illustrated in FIGS. 5 and 6 but is not shown in FIGS. 1–3 for purposes of illustration)
Figure 6:
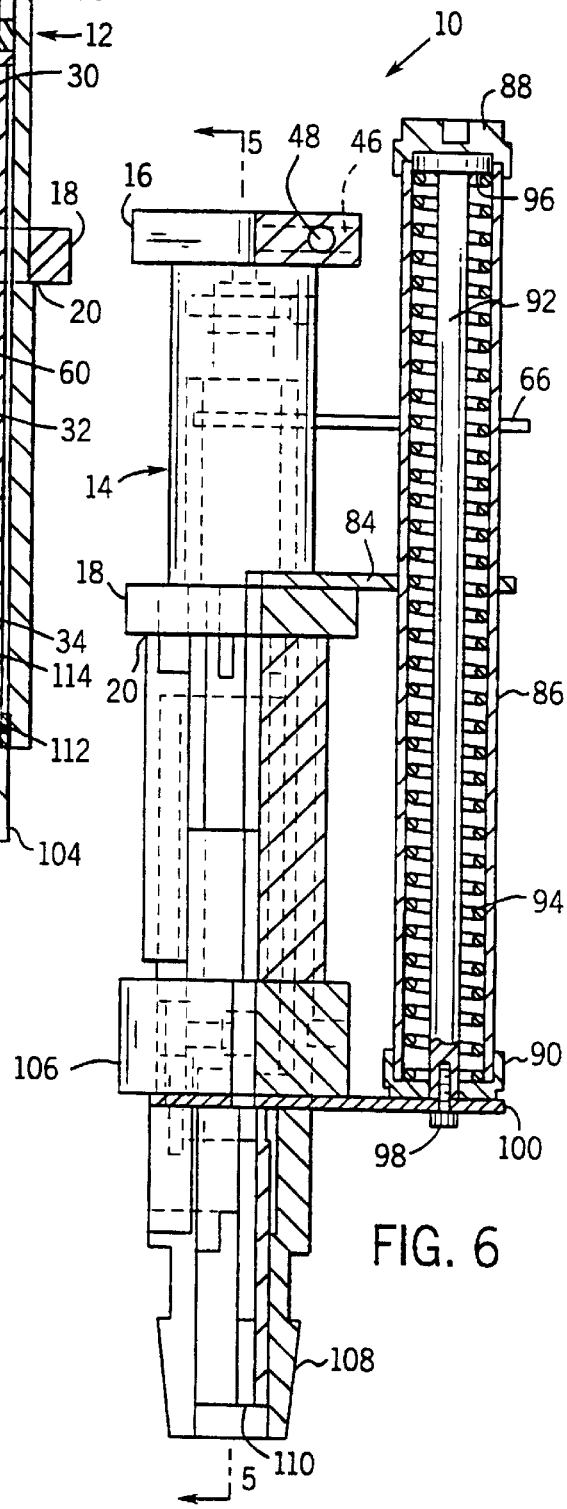
FIG. 6 is a sectional view from the plane of the Line 6—6 of FIG. 5.

The jaws 64 are retained in the housing 62 and biased into the position shown in FIG. 5, in which they are fully open, by a jaw retaining spring 66 (FIGS. 4–6). The spring 66 is essentially a steel rod which is looped and bent as indicated. The two legs 69 of the spring 66 extend through slots 67 in the flange 18 and the end of each leg 69 is threaded into the corresponding jaw 64. When the jaws 64 move together, the spring 66 exerts a force on them which tends to return them to the home (disengaged) position shown in FIG. 5.

Figure 8:
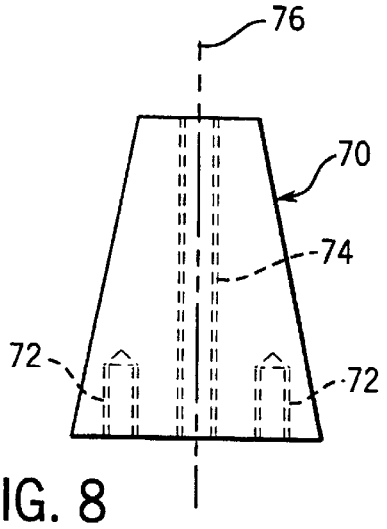
FIG. 8 is a top plan view of gripper jaws for the tensioner of FIGS. 1–6 at a stage of manufacture prior to being cut apart.

The serrations inside the jaws 64 can be made by forming a trapezoidally shaped block 70 of the form shown in FIG. 8, which is equal to the two jaws 64 put together (plus the kerf along central axis 76 which is created when the two jaws 64 are cut apart). The block 70 is bored and tapped with the holes 72 into which the legs 69 of spring 66 are threaded. The block 70 is also bored and tapped with a through bore 74, which is of a diameter approximately equal to the cable diameter. The block 70 is then cut apart along axis 76 to make the two jaws 64 (which cut removes the material in the kerf). The serrations on the concave inner sides 63 of the jaws 64 are provided by the screw threads of bore 74, to grip the cable.

Figure 2:
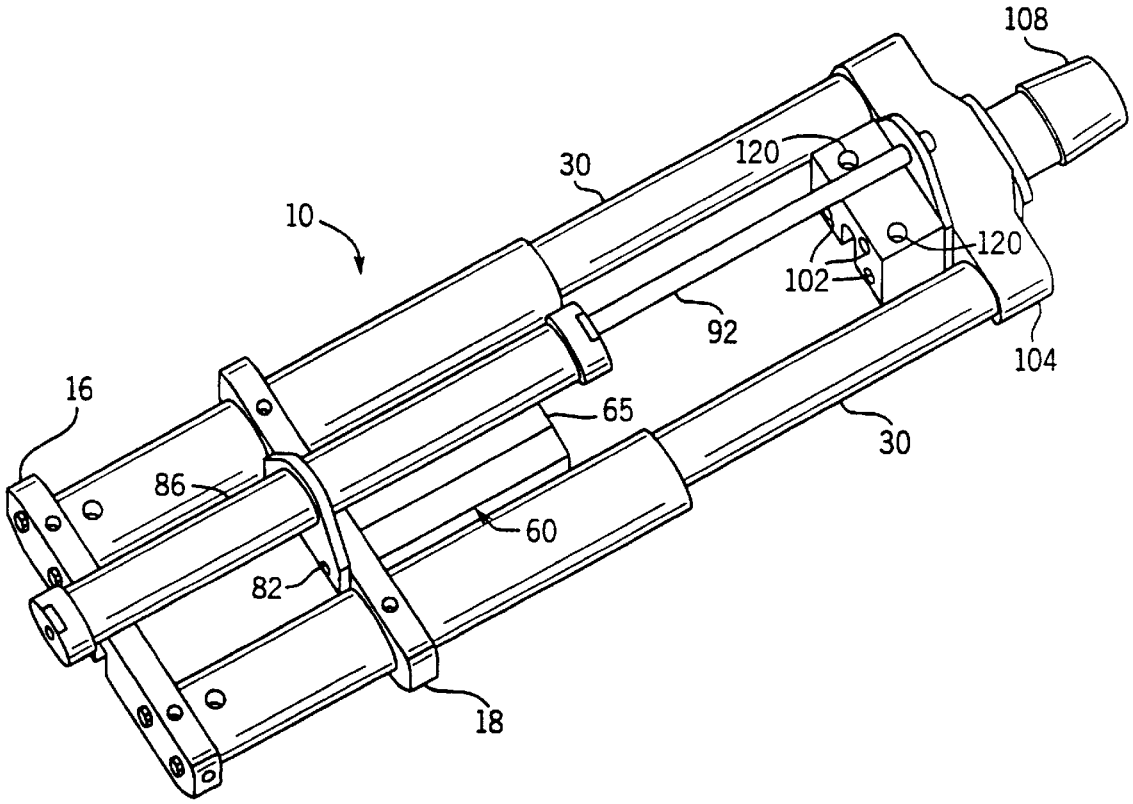
FIG. 2 is a perspective view of the tensioner of FIG. 1 shown in an extended position.
Figure 3:
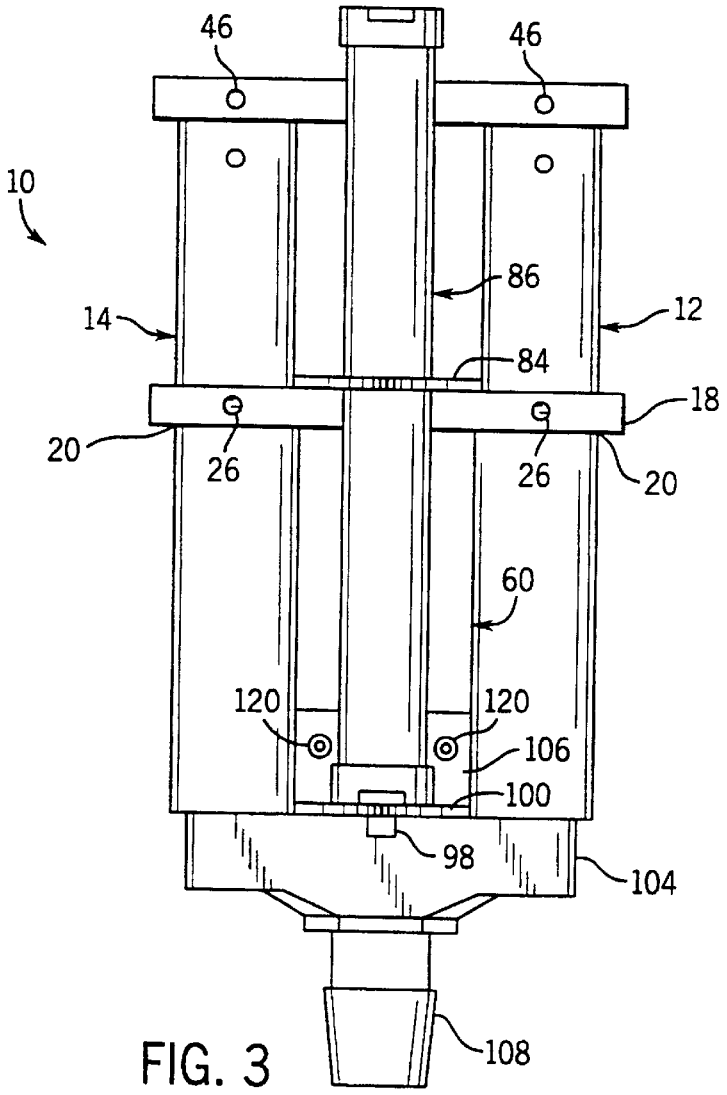
FIG. 3 is a top plan view of the tensioner of FIG. 1.

As best shown in FIG. 5, a cable channel 80 which opens downwardly extends for the full length of the device 10 to permit engagement with the cable and passage of the cable through the device 10. The gripper housing 62 is bolted to the gripper mounting flange 18 by four bolts 82 (only one shown in FIGS. 1 and 2), which extend through holes 85 in the flange 18 and are threaded into tapped holes 83 in the base end 87 of the housing 62 (which includes plates 73), which is the end of the housing 62 closest to the base ends 24 of the cylinders 12 and 14.

The bolts 82 also secure a handle mounting flange 84 to the gripper mounting flange 18. The handle mounting flange 84 is welded to a tubular handle 86 which extends longitudinally with respect to the tensioner 10, parallel to the central axis of the tensioner 10 and above the cylinders 12 and 14. The handle 86 is closed at its base end by a cap 88, which may be vented to permit air to enter the handle 86, and is closed at its rod end by a cap 90 having a central hole through which an auxiliary spring rod 92 extends for sliding movement relative to the cap 90.

The spring rod 92 is biased into the retracted position by a compression spring 94. A flange or plunger 96 is fixed at the base end of the rod 92 for the base end of the spring 94 to bear against and the rod end of the spring bears against the cap 90. The rod end of the rod 92 is secured by a screw 98 to a flange 100 which is bolted by bolts 102 to a yoke 104 that is bolted to both rods 30 via bolt holes 91 (FIG. 5). Alternatively, the rod end of the rod 92 could extend through the flange 100 and be threaded so as to be secured by a nut to the flange 100. Thus, as the device 10 is extended, the spring 94 becomes compressed so as to bias the rod 92 into the retracted position.

The bolts 102 also secure a plunger manifold 106 to the yoke 104. A seat 108 is bolted on the opposite side of the yoke 104 from the manifold 106. As shown in FIG. 5, a plunger 110 is reciprocable in the seat 108 and is biased in an extended position by a pair of springs 112 which are contained in bores 114 in the plunger manifold 106. The springs 112 are compression springs which act between the plunger manifold 106 and a flange 116 of the plunger 110 so as to bias the plunger 110 in the extended position relative to the seat 108. The end of the plunger 110 acts against the face of the grommet which holds the cable under tension in the concrete slab. When the cable is pulled through the grommet by the device 10, the grommet acts against the end face of the plunger 110 to move it into a retracted position in which the grommet permits the cable to slide relative to it so that the cable can be tensioned. However, the plunger 10 maintains a biasing force on the grommet tending to move the grommet into the engaged position in which it bites into the cable and holds the cable under tension.

As an alternative, the springs 112 can be replaced with hydraulic plungers or pistons and hydraulic pressure applied to the back side of the plungers via ports 120 in the plunger manifold 106 so as to positively seat the grommet so that the engagement of the grommet with the cable is made fast after a tensioning operation.

We claim:

1. In a concrete reinforcement cable tensioner of the type having one or more hydraulic cylinders, a cable gripper connected to said cylinder(s) for gripping a reinforcement cable and a seat for bearing directly or indirectly against a concrete slab so that the gripper and the seat can be moved apart under a hydraulically generated force to apply tension to the reinforcement cable, the improvement wherein said gripper is mounted to each said cylinder by a flange which engages a shoulder of each said cylinder; and further comprising a spring external to said cylinder(s) for biasing said cylinder(s) to a retracted position.

2. The improvement of claim 1, wherein said gripper is mounted to said flange at a base end of said gripper, said base end of said gripper being an end of said gripper which is distal from said concrete slab.

3. The improvement of claim 1, wherein said spring is contained in a handle of said tensioner.

4. The improvement of claim 3, wherein said handle is a tube in which said spring is contained and said spring is a compression spring which acts between a flange of an auxiliary spring rod and a cap of said tube.

5. The improvement of claim 4, wherein said rod extends through a hole in a cap of said tube and is fixed at its distal end to the piston rods of said cylinder(s).

6. The improvement of claim 1, wherein said tensioner has multiple cylinders and base ends of said cylinders are hydraulically connected by a manifold which is common to said cylinders.

7. In a concrete reinforcement cable tensioner of the type having one or more hydraulic cylinders, a cable gripper connected to said cylinder(s) for gripping a reinforcement cable and a seat for bearing directly or indirectly against a concrete slab so that the gripper and the seat can be moved apart under a hydraulically generated force to apply tension to the reinforcement cable, the improvement wherein said tensioner further includes a spring external to said cylinder(s) for biasing said cylinder(s) to a retracted position, wherein said spring is contained in a handle of said tensioner.

8. The improvement of claim 7, wherein said handle is a tube in which said spring is contained and said spring is a compression spring which acts between a flange of an auxiliary spring rod and a cap of said tube.

9. The improvement of claim 8, wherein said rod extends through a hole in a cap of said tube and is fixed at its distal end to the piston rods of said cylinder(s).

* * * * *